United States Patent [19]

Fluck

[11] Patent Number: 5,010,715

[45] Date of Patent: Apr. 30, 1991

[54] METHOD AND APPARATUS FOR CONVEYING ARTICLES, PARTICULARLY WAFER-SHAPED FOOD PRODUCTS

[75] Inventor: René Fluck, Schleitheim, Switzerland

[73] Assignee: SIG Schweizerische-Industrie-Gesellschaft, Neuhausen am Rheinfall, Switzerland

[21] Appl. No.: 313,868

[22] Filed: Feb. 23, 1989

[30] Foreign Application Priority Data

Feb. 25, 1988 [CH] Switzerland ..... 708/88

[51] Int. Cl.[5] ..... B65B 5/10; B65B 65/08

[52] U.S. Cl. ..... 53/447; 53/502; 53/504; 53/532; 53/540; 414/21; 414/788.7; 414/789.6; 414/790.3; 414/923

[58] Field of Search ..... 53/447, 501, 502, 504, 53/532, 540; 414/222, 21, 788.7, 923, 789.6, 790.3

[56] References Cited

U.S. PATENT DOCUMENTS 3,584,697 6/1971 Danielson et al. ..... 53/502 X 4,209,960 7/1980 Deutschländer et al. ..... 53/502

4,545,179 10/1985 Rebsamen et al. ..... 53/443

4,827,698 5/1989 Banks ..... 53/502 X

*Primary Examiner*—Robert J. Spar

*Assistant Examiner*—Janice Krizek

*Attorney, Agent, or Firm*—Spencer & Frank

[57] ABSTRACT

A method of supplying stacks of flat articles to a packing machine comprises the following steps: charging receptacles in a dosing device with articles to obtain in each receptacle an article stack shorter and lighter than a predetermined weight and length; advancing some of the charged receptacles to a standby station and some of the charged receptacles to a fine dosing device; and charging the receptacles in the fine dosing device with articles until the predetermined weight and length are substantially reached. The charging step in the fine dosing device includes the step of transferring articles from a receptacle dwelling in the standby station to a receptacle dwelling in the fine dosing device. Thereafter, the receptacles are advanced from the fine dosing device to the packing machine. The empty receptacles are advanced from the packing machine and the standby station to the dosing device.

7 Claims, 4 Drawing Sheets

Fig. 2
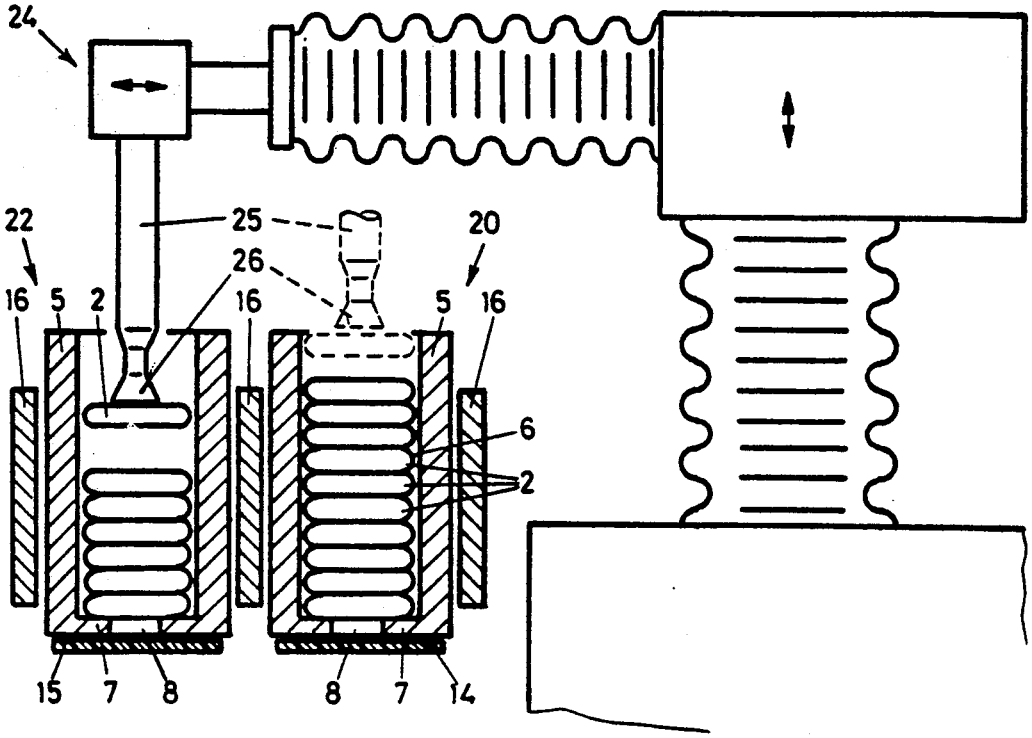
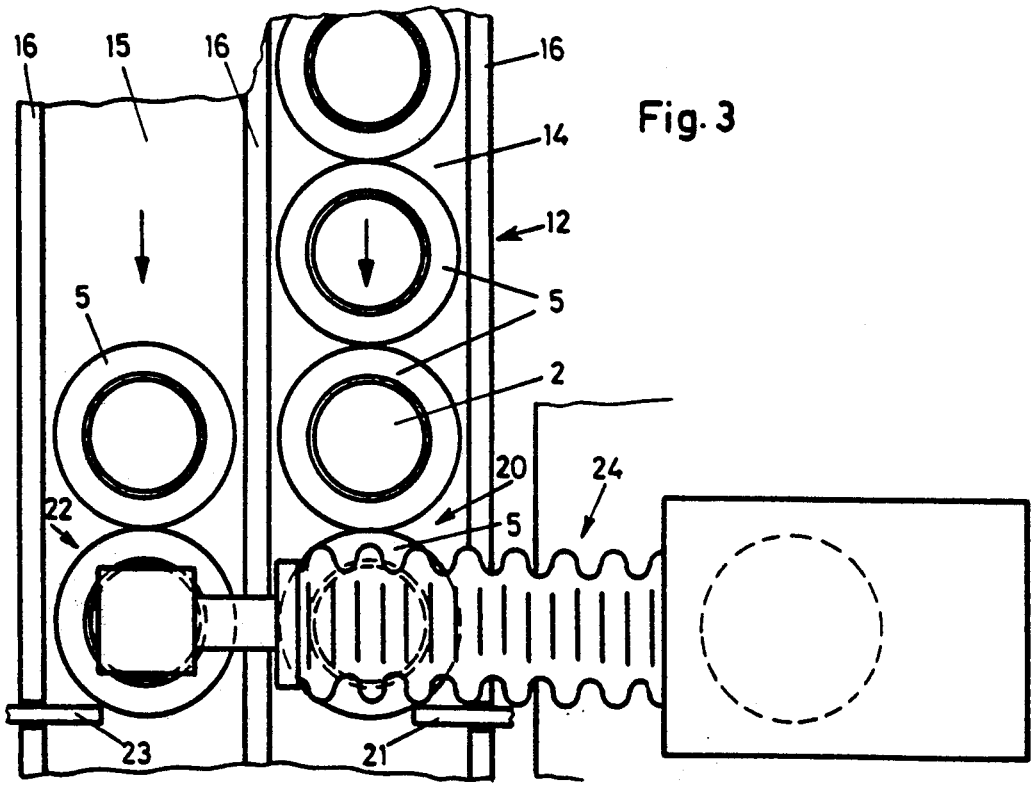
Fig. 3

METHOD AND APPARATUS FOR CONVEYING ARTICLES, PARTICULARLY WAFER-SHAPED FOOD PRODUCTS

BACKGROUND OF THE INVENTION

This invention relates to a method, apparatus and receptacle for conveying flat, stacked articles, particularly wafer-like food products, such as cookies, crackers or the like from a grouping (dosing) device to a packing machine.

U.S. Pat. No. 4,545,179 discloses the division of confectionery food products into groups of counted articles prior to packaging and to measure the length of the groups. Excessively long or short groups are separated out from the article flow. Subsequent to packaging the completed packages are weighed and the underweight packages eliminated. For setting the number of articles to be counted in one group the package weight is determined by measuring a plurality of packages. Although in this manner the average excess weight of the packages is maintained at a small value, waste occurs continuously.

Particularly the completed, underweight packages are highly inconvenient since they adversely affect the overall efficiency of the operation. These problems are further accentuated in case the weight of the articles fluctuates relatively substantially which in certain types of food products cannot be avoided.

SUMMARY OF THE INVENTION

It is an object of the invention to provide an improved apparatus and method for conveying articles of the above-outlined type from a metering device to a packing machine such that waste due to package weights outside the weight tolerances can be eliminated.

This object and others to become apparent as the specification progresses, are accomplished by the invention, according to which, briefly stated, the method of supplying stacks of flat articles to a packing machine comprises the following steps: charging receptacles in a dosing device with articles to obtain in each receptacle an article stack shorter and lighter than a predetermined weight and length; advancing some of the charged receptacles to a standby station and some of the charged receptacles to a fine dosing device; and charging the receptacles in the fine dosing device with articles until the predetermined weight and length are substantially reached. The charging step in the fine dosing device includes the step of transferring articles from a receptacle dwelling in the standby station to a receptacle dwelling in the fine dosing device. Thereafter, the receptacles are advanced from the fine dosing device to the packing machine. The empty receptacles are advanced from the packing machine and the standby station to the dosing device.

BRIEF DESCRIPTION OF THE DRAWING

FIG. 2 is a schematic side elevational view, partially in section, of a transfer loading device forming part of the preferred embodiment.

FIG. 3 is a schematic top plan view of the transfer loading device shown in FIG. 2.

DESCRIPTION OF THE PREFERRED EMBODIMENTS

Figure 1:
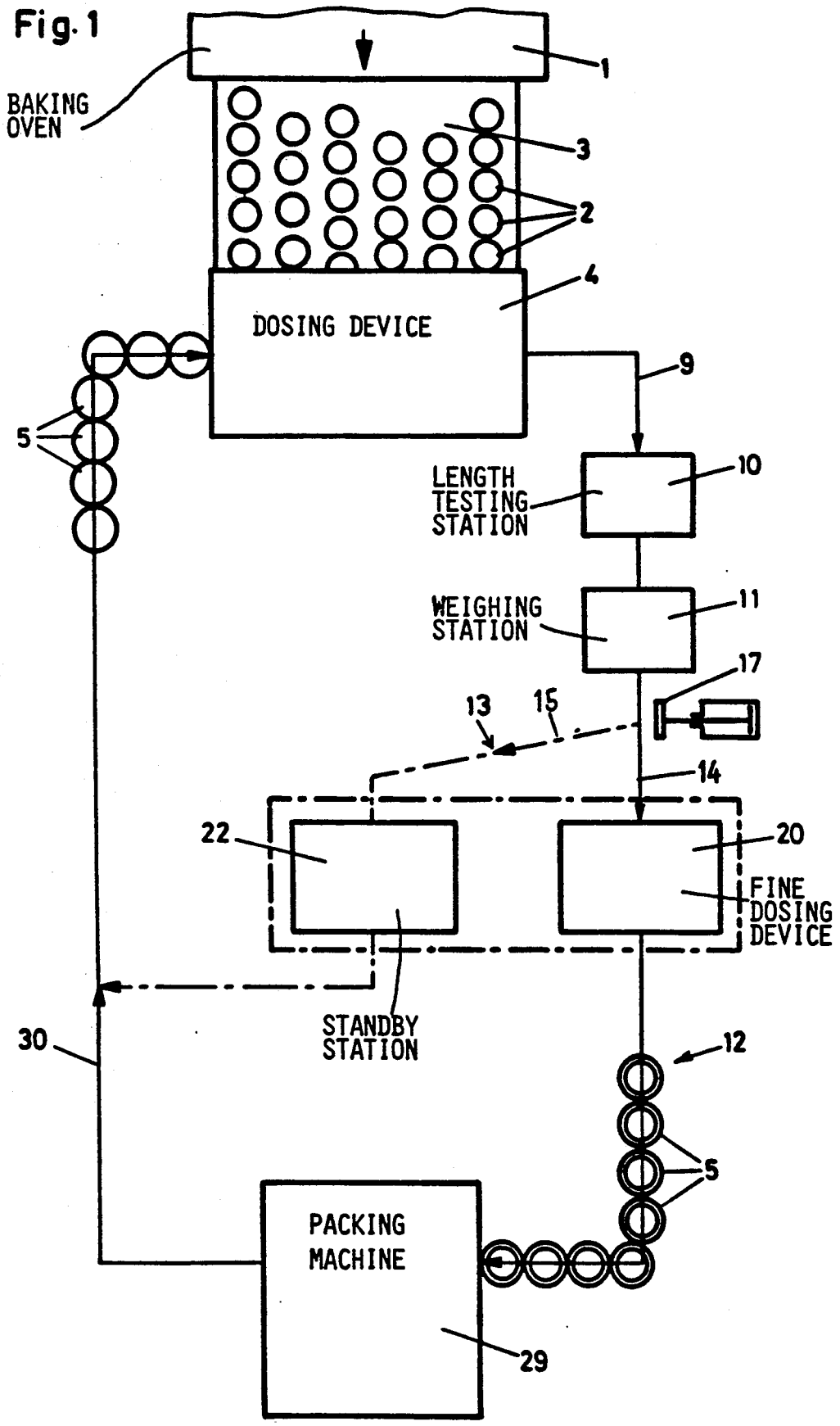
FIG. 1 is a schematic top plan view, with block diagram, of a preferred embodiment of the apparatus according to the invention.

FIG. 1 is a schematic illustration of a preferred embodiment of the invention. A continuous baking oven 1 discharges baked confectionery items, such as cookies, crackers or biscuits 2 in a plurality of columns onto a conveyor 3 which advances the articles 2 to a dosing device 4.

In the dosing device 4 from each column of articles a predetermined, settable number of articles 2 is vertically stacked in individual tubular receptacles 5. The number of articles 2 present in the stacks 6 received in the receptacles 5 is set in such a manner that the stack 6 is slightly shorter than the stack length intended for packaging and also, it weighs slightly less than the intended net weight. Expediently, the number of articles 2 is set such in the stacks 6 that approximately 1–2 articles are missing for complementing the intended net weight and intended package length.

From the dosing apparatus 4 the grouped articles 2 are, in the receptacles 5, advanced on a conveyor belt 9 and pass through a length testing station 10 in which the length of the stacks 6 is measured. Thereafter the articles pass through a weighing station (scale) 11 where the weight of each stack 6 is determined. Conventional arrangements are provided to generate, in the length testing station 10 and the weighing station 11 output signals representing the length and weight of the stack tested therein. Downstream of the weighing station 11 the column of the receptacles 5 is divided into two conveying tracks 12 and 13 each including a respective conveyor belt 14 and 15.

Turning now to FIGS. 2 and 3, the receptacles 5 travelling on the first conveying track 12 are admitted between two guide rails 16 to a supplemental (fine) dosing station 20 in which the leading receptacle 5 is held back by means of a horizontally shiftable bolt 21. Containers 5 which are excessively underweight or which have excessively short or long stacks 6 or are empty are shifted by a pusher 17 (FIG. 1) from the conveyor belt 14 onto the conveyor belt 15 of the second conveying track 13 which leads to a standby station 22 provided with a horizontally shiftable holdback gate 23. The two stations 20 and 22 are situated closely side by side and are served by a transfer loading device 24 which comprises a vertically and horizontally displaceable bar 25 provided with a suction cup 26 at its lower end. The bar 25 may horizontally travel back and forth between the two stations 20 and 22.

To perform a supplemental dosing, the transfer loading device 24 grasps, with the suction cup 26, articles 2 in the receptacle 5 dwelling in the standby station 22 and charges the receptacle 5 dwelling in the supplemental dosing station 20 until the minimum net weight is reached therein. The number of articles required to obtain such a result is determined by the scale 11 and the data obtained thereby are stored until the respective receptacle 5 reaches the supplemental dosing station 20. As soon as the stack 6 in the receptacle 5 dwelling in the supplemental dosing station 20 is completed, the hold-back gate 21 is withdrawn whereupon the receptacle 5 continues its travel on the first conveying track 12 by means of the conveyor belt 14 and is advanced to a packing machine 29 (FIG. 1) where the stack 6 is removed from the receptacle 6 and is packaged. The empty receptacles 5 are conveyed back to the dosing device 4 on a further conveyor belt 30 to be again filled with an article stack.

As soon as a receptacle 5 is empty in the standby station 22, the retaining bar 23 is withdrawn. Such an empty condition can be determined by the amplitude of the vertical stroke of the bar 25 when the last article 2 is grasped by the suction cup 26. As a result of the withdrawal of the retaining bar 23, the empty receptacle 5 is admitted to the second conveying track 13 and is, on the conveyor belt 15, advanced to the conveyor belt 30 and is admitted into the column of the empty receptacles 5. The pusher 17 is controlled in such a manner that upstream of the standby station 22 at all times not less than one, at least partially filled receptacle is present.

By virtue of the above-described apparatus, the packing machine 29 receives exclusively article stacks 6 with the correct minimum weight and a stack length within the determined tolerances so that the packing machine 29 may be operated in an optimal manner. Empty cycles and other disturbances caused because of incorrect stack lengths may be entirely eliminated. Further, a weighing of the completed packages and an elimination of underweight completed packages is no longer needed. The articles for the supplemental dosing are branched off the principal circuit. Consequently, no additional quantities for the supplemental dosing from another supply column are necessary.

Figure 4:
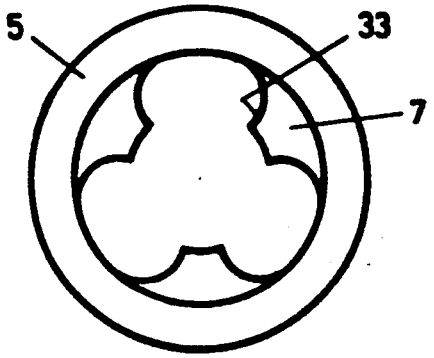
FIGS. 4 and 5 are top plan views of two embodiments of a receptacle forming part of the invention.
Figure 5:
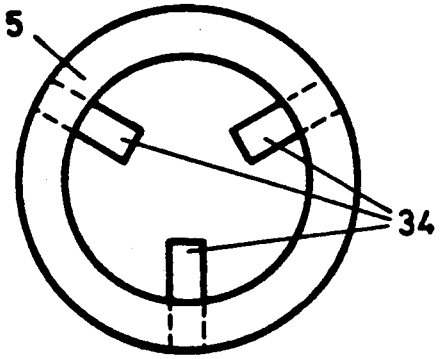
Figure 6:
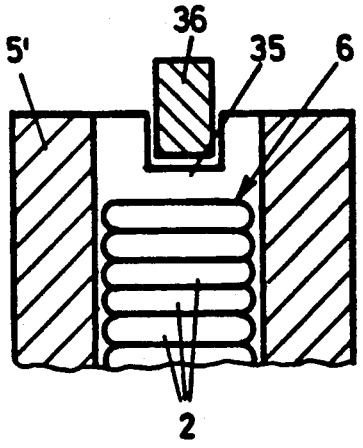
FIG. 6 is a fragmentary sectional elevational view of still another embodiment of the container forming part of the invention.
Figure 7:
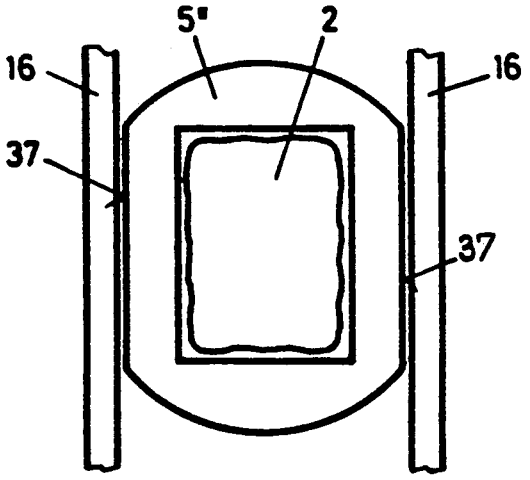
FIG. 7 is a top plan view of yet another embodiment of the receptacle forming part of the invention.

The receptacles 5 illustrated in FIGS. 1, 2 and 3 are of circular cylindrical configuration and are open at both ends and are further provided at the lower end with a flange 7 which supports the article stack 6 within the receptacle. A pickup base may be introduced through a lower central opening 8 in the receptacle 5 in the dosing device 4. The pickup base is then intermittently moved downwardly as the articles are charged in sequence to form the article stack 6. In the packing machine 29 the stack 6 is pushed out through the opening 8 by means of a pusher. As shown in FIG. 4, the flange 7 may have cutouts 33. As shown in FIG. 5, instead of a flange 7 stack retaining pins 34 may be held in the wall of the receptacle 5. The receptacle 5 illustrated in FIGS. 1-5 is adapted to receive articles of circular outline. In case of rectangular articles, these have to be supplied to the packing machine 29 in a particular orientation. For this purpose, receptacles 5' illustrated in FIG. 6 are used. At the upper edge of the receptacle 5' a groove 35 is formed which is guided by a rail 36 extending thereinto. According to another variant of the receptacle, illustrated at 5'' in FIG. 7, it is feasible to provide the receptacle with two oppositely located parallel planar surfaces 37 which are guided between parallel spaced guide rails 16.

Figure 8:
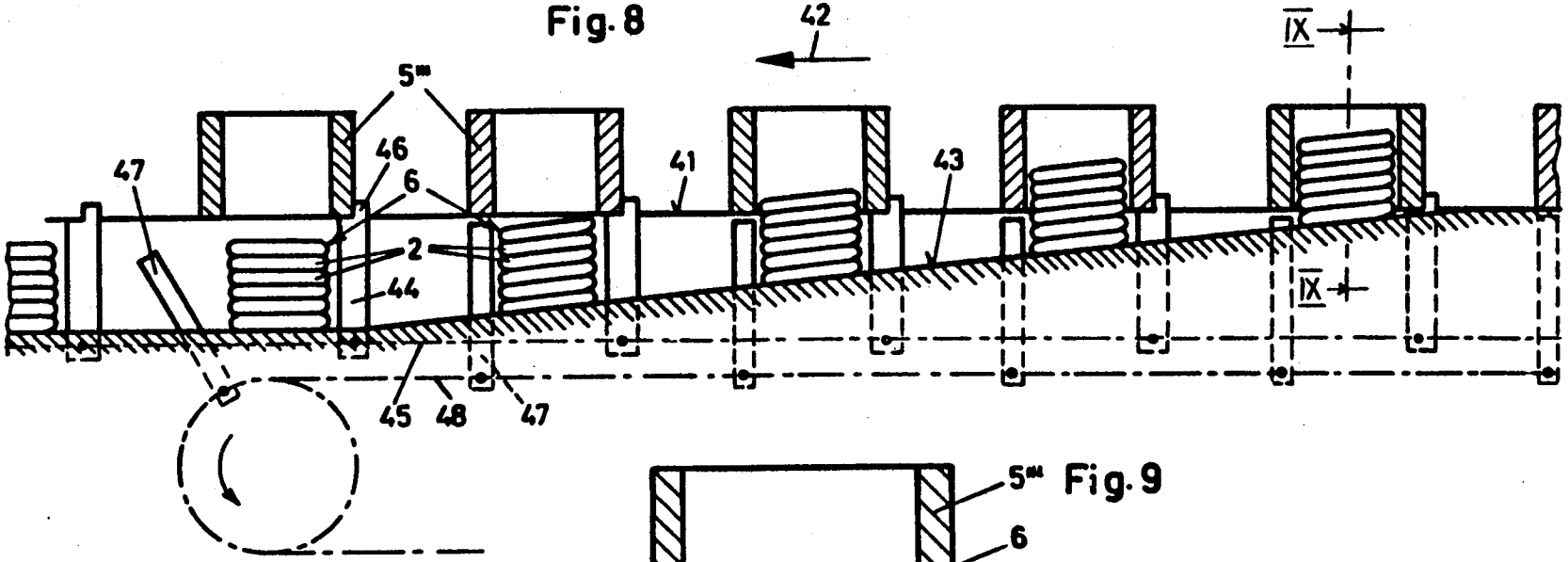
FIG. 8 is a schematic sectional side elevational view of an unloading device forming part of the invention.
Figure 9:
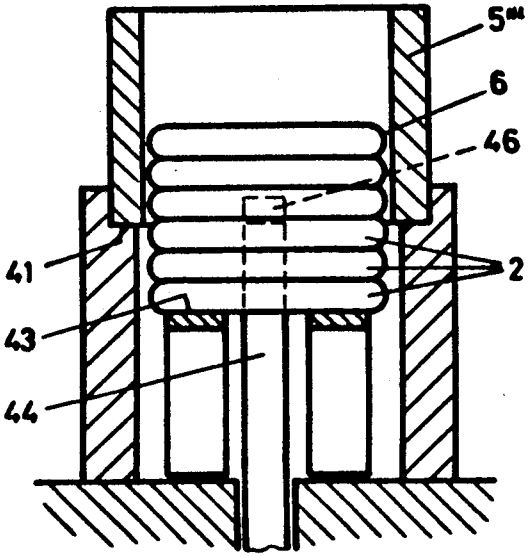
FIG. 9 is a sectional enlarged view taken along line IX—IX of FIG. 8.

Still another variant of the receptacle is shown in FIG. 8 and designated at 5'''. The receptacles 5''' are cylindrical, bilaterally fully open, pipe-like structures so that the stack 6 may be removed through the bottom of the receptacles 5''' in the packing machine 29. For this purpose, the receptacles 5''' are supported on two lateral horizontal rails 41. Between the rails 41 there is arranged a ramp 43 which slopes downwardly in the conveying direction 42 and which has a central longitudinal slot covered by the stacks 6 as they rest on the ramp 43. Fingers 44 secured at uniform distances to a circulating endless chain 45 project through the central longitudinal slot of the ramp 43. The fingers 44 have an upper terminal lug 46 which projects vertically beyond the rails 41 and pushes the containers 5''' in the conveying direction 42. During the course of the conveyance of each receptacle 5''' on the horizontally aligned rails 41 the stacks 6 resting on the downwardly sloping ramp 43 move out in a downward direction from the receptacles 5''' and are pushed by the fingers 44 forwardly on the ramp 43. To prevent the stacks 6 from tipping over, further guide fingers 47 may be used which may be attached to a second, synchronously driven chain 48 and which extend above the face of the ramp 43 through another longitudinal slot provided in the ramp. After the stacks 6 have been moved out of the respective receptacle 5''' in the downward direction, such receptacle is shifted by a pusher laterally onto the return conveyor belt 30.

The apparatus illustrated in FIG. 8 is also adapted to charge the receptacles 5''' in the dosing device 4. For that purpose, the ramp 43 is inclined in an opposite orientation, that is, it slopes upwardly in the direction of conveyance.

It will be understood that the above description of the present invention is susceptible to various modifications, changes and adaptations, and the same are intended to be comprehended within the meaning and range of equivalents of the appended claims.

What is claimed is:

1. A method of supplying stacks of flat articles to a packing machine; each article stack being of predetermined weight and length; comprising the following steps:

(a) charging receptacles in a dosing device with articles to obtain in each receptacle an article stack shorter and lighter than said predetermined weight and length;

(b) advancing some of the charged receptacles to a standby station and some of the charged receptacles to a fine dosing device;

(c) charging the receptacles in the fine dosing device with articles until the predetermined weight and length are substantially reached; said charging step in said fine dosing device including the step of transferring articles from a receptacle dwelling in said standby station to a receptacle dwelling in the fine dosing device;

(d) subsequent to step (c), advancing the receptacles from the fine dosing device to the packing machine; and (e) advancing empty receptacles from the packing machine and the standby station to the dosing device.

2. A method as defined in claim 1, further comprising the steps of advancing, after step (a) and before step (b), the charged receptacles to a testing station; and determining at least one of the weight and length of each stack in the testing station.

3. An apparatus for supplying stacks of flat articles to a processing station; the stacks being of predetermined weight and length, comprising (a) a plurality of receptacles;

(b) a first dosing means for charging the receptacles with articles to obtain in each receptacle an article stack shorter and lighter than said predetermined weight and length;

(c) means for introducing articles into said first dosing means;

(d) a first conveyor extending from the processing station to the first dosing means for introducing said receptacles in an empty state into said first dosing means;

(e) a second conveyor arranged to carry away the receptacles from said first dosing means charged therein;

(f) a standby station;

(g) a third conveyor extending from said second conveyor to said standby station;

(h) means for transferring some of the charged receptacles from the second conveyor to the third conveyor for introduction into the standby station;

(i) a second dosing means arranged to receive charged receptacles from said second conveyor; said second dosing means including a transfer means transferring articles from a receptacle dwelling in said standby station to a receptacle dwelling in the second dosing means until said predetermined weight and length of the article stack is reached in the receptacle dwelling in said second dosing means;

(j) a fourth conveyor extending from said second dosing means to carry charged receptacles from the second dosing means to the processing station; and (k) means for transferring empty receptacles from the standby station to the first conveyor.

4. An apparatus as defined in claim 3, further comprising testing means arranged downstream of the first dosing means and upstream of the second dosing means as viewed in a travelling direction of the receptacles on the second conveyor for determining at least one of the weight and length of each stack.

5. An apparatus as defined in claim 3, wherein said second conveyor has a conveyor portion in said second dosing means and said third conveyor has a portion in said standby station; said portions being situated side-by-side and being parallel to one another.

6. An apparatus as defined in claim 5, wherein said transfer means of said second dosing means comprises a suction cup for grasping the articles by suction; means for vertically moving said suction cup; and means for horizontally shifting the suction cup into and out of the standby station.

7. An apparatus for supplying stacks of flat articles to a packing machine; the apparatus including a dosing device, a standby station and a fine dosing device; each article stack being of predetermined weight and length; comprising (a) means for charging receptacles in the dosing device with articles to obtain in each receptacle an article stack shorter and lighter than said predetermined weight and length;

(b) means for advancing some of the charged receptacles to the standby station and some of the charged receptacles to the fine dosing device;

(c) means for charging the receptacles in the fine dosing device with articles until the predetermined weight and length are substantially reached; said means for charging in said fine dosing device including means for transferring articles from a receptacle dwelling in said standby station to a receptacle dwelling in the fine dosing device;

(d) means for advancing the receptacles from the fine dosing device to the packing machine; and (e) means for advancing empty receptacles from the packing machine and the standby station to the dosing device.

* * * * *